US006949006B1

(12) United States Patent
Chen et al.

(10) Patent No.: US 6,949,006 B1
(45) Date of Patent: Sep. 27, 2005

(54) BELT-DISC SANDER HAVING SPEED ADJUSTER

(75) Inventors: Yu-Kai Chen, Chiai (TW); Tsai-Fu Wu, Chiai (TW); Yung-Chun Wu, Kaohsiung (TW); Wen-Yang Wang, Nantou (TW); Chin-Hsiung Chang, Taichung (TW)

(73) Assignee: Fego Precision Industrial Co., Ltd., Taichung (TW)

( * ) Notice: Subject to any disclaimer, the term of this patent is extended or adjusted under 35 U.S.C. 154(b) by 0 days.

(21) Appl. No.: 10/915,540

(22) Filed: Aug. 11, 2004

(51) Int. Cl.[7] ..... B24B 1/00

(52) U.S. Cl. ..... 451/5; 451/296; 451/8; 451/259; 318/268

(58) Field of Search ..... 451/5, 8, 296, 451/259; 318/268, 599, 606, 820, 807–811, 318/823

(56) References Cited

U.S. PATENT DOCUMENTS 4,851,743 A * 7/1989 Schmerda et al. ..... 388/811
5,038,084 A * 8/1991 Wing ..... 318/268
5,301,471 A * 4/1994 Fisher et al. ..... 451/357
5,800,249 A * 9/1998 Levy et al. ..... 451/41
6,102,781 A * 8/2000 Greathouse et al. ..... 451/59
6,198,240 B1 * 3/2001 Notohara et al. ..... 318/268
6,201,929 B1 * 3/2001 Yu ..... 388/806
6,320,286 B1 * 11/2001 Ramarathnam ..... 310/50
6,474,913 B2 * 11/2002 Katoh et al. ..... 409/131
6,548,983 B2 * 4/2003 Avella et al. ..... 318/599

* cited by examiner

*Primary Examiner*—George Nguyen
(74) *Attorney, Agent, or Firm*—Troxell Law Office, PLLC

(57) ABSTRACT

A speed adjuster is provided in a belt-disc sander for controlling the rotating speed of a motor of the belt-disc sander. A speed adjust knob is disposed outside the belt-disc sander. The speed adjuster has a control circuit, a current sensor, a drive circuit, and a converter. The current sensor detects the motor current and feeds back to the control circuit, which controls the frequency variation of a SPWM signal of the drive circuit in response to the input of the speed adjust knob. The converter transforms the square wave voltage into an AC voltage for driving the motor. The desired rotating speed can be adjusted through the speed adjust knob. The control circuit will compare the present rotating speed of the motor with the set rotating speed to determine whether the present rotating speed conforms to the set one for correcting the rotating speed of the motor.

11 Claims, 2 Drawing Sheets

BELT-DISC SANDER HAVING SPEED ADJUSTER

BACKGROUND OF THE INVENTION

1. Field of the Invention

The present invention relates to a belt-disc sander having a speed adjuster and, more particularly, to a belt-disc sander whose rotating speed can be adjusted.

2. Description of Related Art

Belt-disc sanders are a processing mechanisms commonly used in both domestic and industrial settings. They can save money and reduce the attrition rate of manual tools. In addition to the common belt sander, there are also fast-rotating disc sanders for processing larger end faces. An emery cloth or emery paper is laid on an end face of a sanding disc, and a disc platen is disposed on the end face corresponding to the sanding disc having the emery cloth or emery paper.

Therefore, a sanding belt or a sanding disc can be chosen for processing from the belt-disc sander in respond to the shape of an object. For most existent belt-disc sanders, however, the rotating speed is fixed. The processing of the end face of any object is carried out with a fixed rotating speed. Multiple choices of rotating speed are not provided to meet the requirements for the processing of different objects.

Accordingly, the present invention aims to propose a belt-disc sander having a speed adjuster to solve the problems in the prior art.

SUMMARY OF THE INVENTION

An object of the present invention is to provide a belt-disc sander having a speed adjuster for adjusting the rotating speed of the belt-disc sander.

Another object of the present invention is to provide a belt-disc sander having a speed adjuster to provide more precise control of the rotating speed of the motor.

To achieve the above objects, the present invention provides a belt-disc sander having a speed adjuster for controlling the rotating speed of the motor of the belt-disc sander. The speed adjuster comprises a drive circuit, a converter, a current sensor, a speed adjust knob, and a control circuit. The drive circuit is used for generating a sinusoidal pulsed-width-modulation (SPWM) signal. The is coupled with the drive circuit for receiving the SPWM signal and generating a rotating speed control voltage for driving the motor. The current sensor is coupled with the motor for feedback of the current of the motor. The speed adjust knob is used for generating a speed adjust signal. The control circuit is coupled between the drive circuit and the speed adjust knob for controlling the rotating speed of the motor. The control circuit controls the frequency variation of the SPWM signal generated by the drive circuit in response to the speed adjust signal of the speed adjust knob so that the rotating speed control signal output by the converter can be adjusted according to the frequency variation of the SPWM signal for adjusting the rotating speed of the motor. The control circuit can also determine whether the rotating speed of the motor conforms to that set by the speed adjust knob for correcting the frequency variation of the SPWM signal generated by the drive circuit.

The converter is preferably a half-bridge inverter. The current sensor is preferably a current transformer (CT). The speed adjust knob is preferably a potentiometer.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
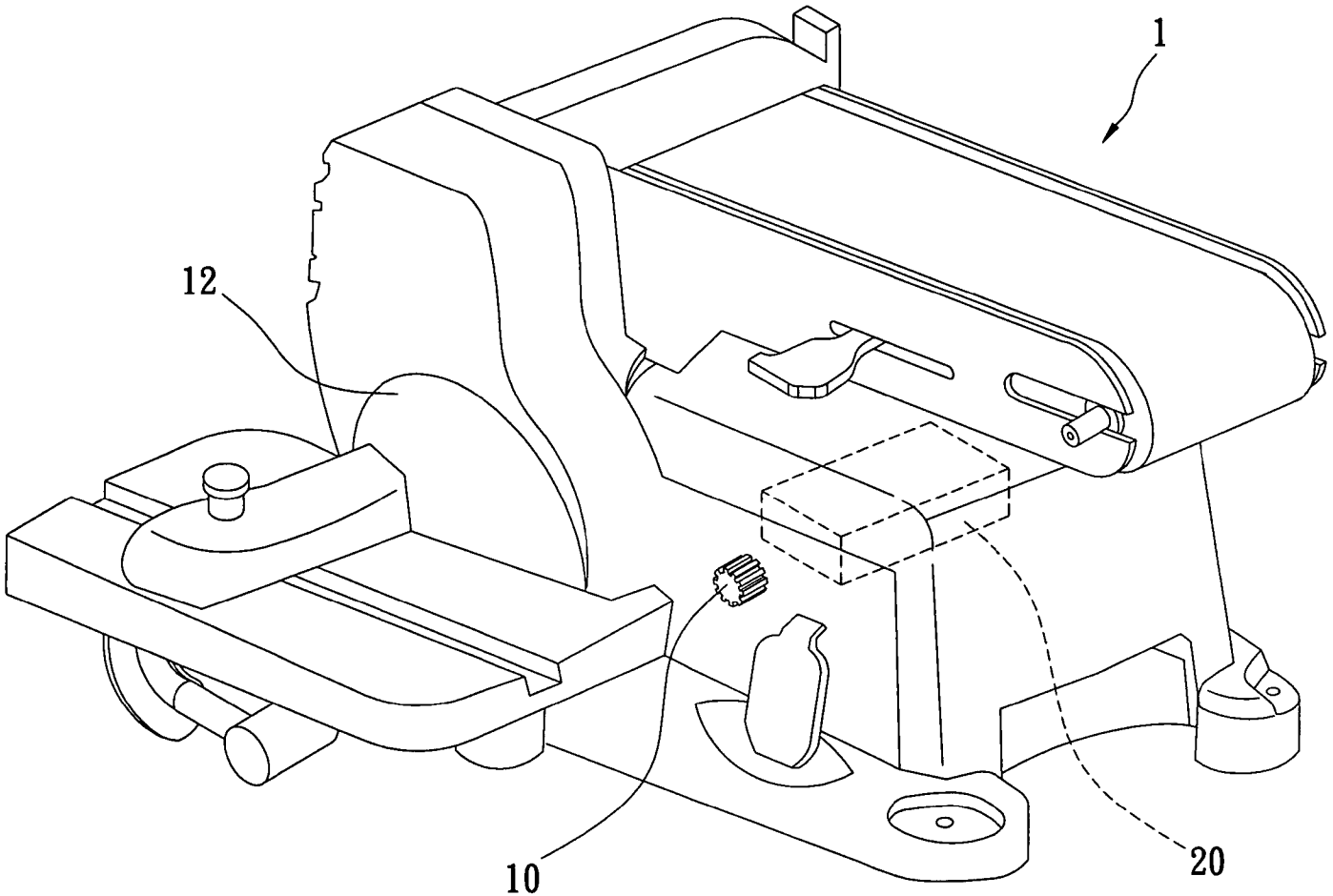
FIG. 1 is a perspective view of a preferred embodiment of the present invention.

A machine platen 1, a belt-disc sander, is shown in FIG. 1. The present invention adds a speed adjuster 20 to the machine platform 1 to control the rotating speed of a motor 12 that drives a sanding belt and a sanding disc. A speed adjust knob 10 is disposed on the exterior of the machine platform 1. A user can manipulate the speed adjust knob 10 to send a speed adjust signal to the speed adjuster 20 to make the rotating speed of the motor 12 meet his or her requirement.

Figure 2:
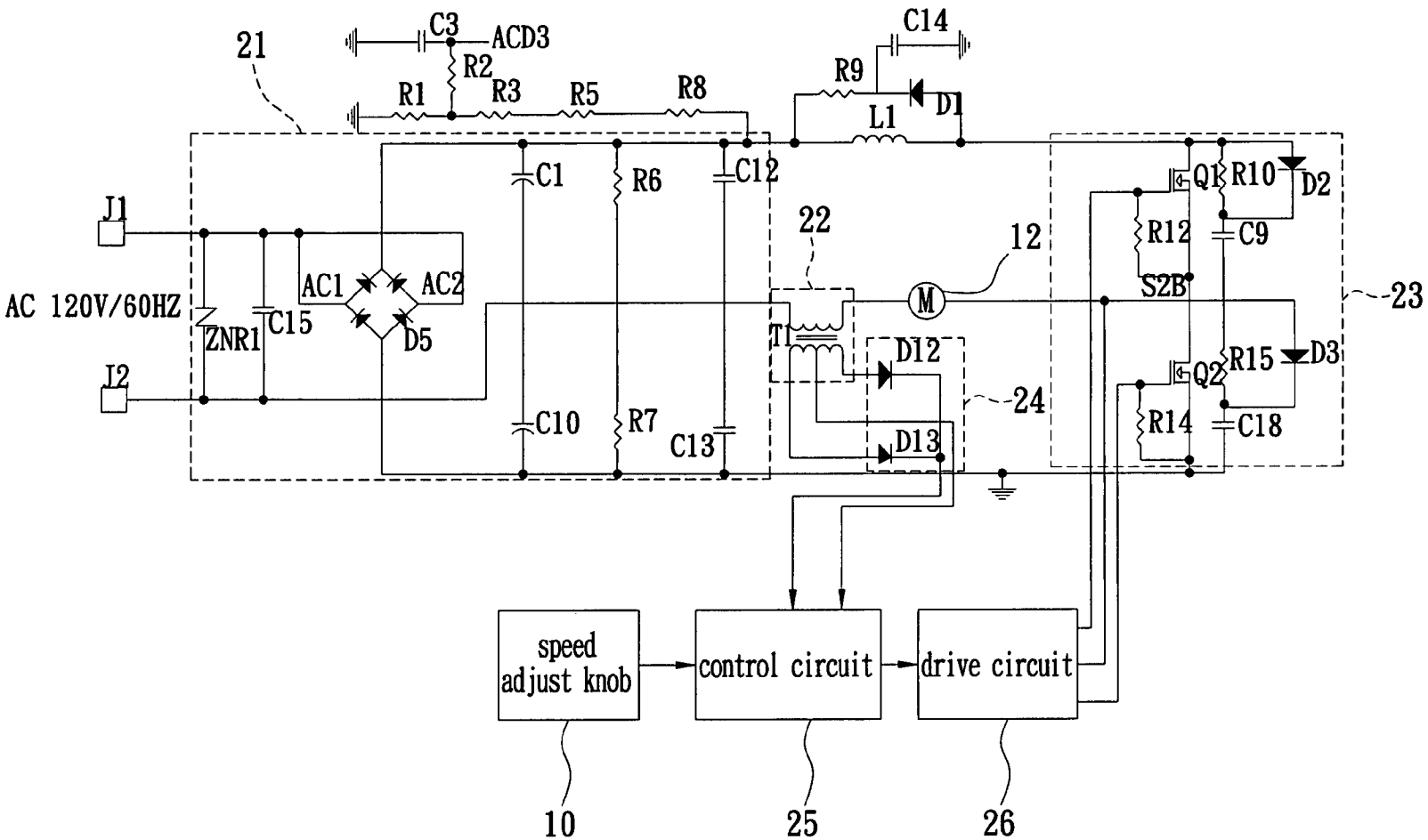
FIG. 2 is a circuit diagram of a speed adjuster according to a preferred embodiment of the present invention.

As shown in FIG. 2, the speed adjuster 20 mainly comprises a voltage doubling circuit 21, a current sensor 22, a converter 23, a control circuit 25 and a drive circuit 26.

The voltage doubling circuit 21 is used to convert an AC input voltage into a double DC output voltage for providing the required power level for the converter 23 to drive the motor 12 to rotate.

The current sensor 22 is coupled with the motor 12, and is mainly used to detect the current variation of the motor 12 and feed the current to the control circuit 25 so that the control circuit 25 can detect the operational status of the motor 12 from the current variation of the motor 12. In this embodiment, the current sensor 22 is preferably a current transformer. Through the characteristics of a current transform, the large current of the motor 12 can be transformed into a relative voltage signal for determination of the control circuit 25. The primary side of the current transformer is coupled with the loop between the voltage doubling circuit 21 and the motor 12, and the secondary side (output terminal) of the current transformer is coupled with a full-wave rectifier 24, which converts an AC signal output by the current transformer into a DC signal and sends to the control circuit 25.

The control circuit 25 is coupled between the speed adjust knob 10 and the drive circuit 26, and provides programmable manipulation to control the rotating speed of the motor 12. The control circuit 25 can receive a speed adjust signal of the speed adjust knob 10 and send a command to control the drive circuit 26 in response to the desired speed adjust signal. The control circuit 25 can detect the rotating speed of the motor 12 from the detection result of the current sensor 22 and compare the same with the speed adjust signal of the speed adjust knob 10 to determine whether the present rotating speed of the motor 12 conforms to that set by the speed adjust knob 10, thereby correcting the rotating speed of the motor 12.

In this embodiment, the control circuit 25 is a micro-control unit for adjusting the rotating speed of the motor 12. The micro-control unit provides programmable operations with firmware. Therefore, the adjustment of the rotating speed of the motor 12 is determined by the codes burned in the micro-control unit. Matched with the function of the converter 23, a rotating speed adjust command is sent to the drive circuit 26 to change the operating voltage and current frequency of the motor 12, thereby changing the rotating speed of the motor 12 in a discontinuously or continuously variable manner.

The drive circuit 26 is coupled between the control circuit 25 and the converter 23, and is mainly used to generate a square wave signal and output to the converter 23. In this embodiment, the drive circuit 26 is preferably a sinusoidal pulse width modulation (SPWM) signal generator. An intersection point obtained through comparison between a reference wave and a carrier wave is used to determine the SPWM square wave signal.

The converter 23 is coupled between the drive circuit 26 and the motor 12. The converter 23 is used to transform an input DC voltage into an output AC signal (i.e., a desired speed control signal) for driving the motor 12 to rotate. In this embodiment, the converter 23 is a half-bridge dc/ac converter (inverter). Switching components (Q1, Q2) in the converter 23 are used to match the input SPWM signal to obtain an AC signal sent to the motor 12.

The output frequency of the converter 23 is controlled by the frequency variation of the SPWM signal. That is, if the SPWM signal is set at a fixed frequency, the output frequency of the converter 23 remains constant. By increasing or decreasing the SPWM signal frequency, the output frequency of the converter 23 can be increased or decreased to change the operating frequency of the motor 12, hence controlling and adjusting the rotating speed of the motor 12.

The present invention provides a closed-loop control method to adjust the rotating speed of the motor 12. The current sensor 22 informs the control circuit 25 of the current variation of the motor by feedback. The control circuit 25 can detect the present rotating speed of the motor 12 from the feedback current of the motor 12 to determine whether the rotating speed of the motor 12 conforms to the setting. The control circuit 25 will send out a command to the drive circuit 26 to change the SPWM signal frequency in response to the input speed adjust signal of the speed adjust knob 10. The converter 23 can thus change the operating voltage of the motor 12 in response to the frequency variation of the SPWM signal to adjust the rotating speed of the motor 12 in a discontinuously or continuously variable manner.

Because the control circuit 25 is a micro-control unit circuit providing programmable and flexible operations, the rotating speed of the motor 12 of the belt-disc sander having a speed adjuster of the present invention can be more flexibly changed in a discontinuously or continuously variable manner. Moreover, the belt-disc sander applies to precise processing of objects of different materials. Further, when the belt-disc sander operates at a constant torque with low frequency variation, if the rotating speed is too low (from the detection result of the current sensor 22), the control circuit 25 can increase the operating frequency of the motor 12 to maintain a constant rotating speed and avoid saturation of the motor 12.

The belt-disc sander can further be activated at any desired frequency. When the belt-disc sander is activated at a low frequency, the amplitudes of the operating voltage and current of the motor 12 are first raised to activate the motor 12 until the current of the motor 12 drops (from the detection result of the current sensor 22), and the SPWM signal is then continuously adjusted to the set frequency to keep at the required rotating speed (i.e., the rotating speed set by the speed adjust knob). When the sanding belt or sanding disc of the belt-disc sander rotates at any desired frequency, if the motor 12 is jammed (from the detection result of the current sensor 22), a protection time can be set by the control circuit 25. The control circuit 25 will send out a command to stop the motor 12 if the jam time of said motor exceeds the protection time, or the control circuit 25 will activate the motor again if the jam time does not exceed the protection time.

To sum up, the present invention combines a speed adjuster 20 in a belt-disc sander to control the rotating speed of the belt-disc sander. Moreover, the speed adjuster 20 of the present invention is a closed-loop control system capable of more accurately controlling the rotating speed of the motor 12 and detecting the operational status of the motor 12 through the current sensor 22. The control circuit 25 can thus determine whether the rotating speed of the motor 12 needs to be adjusted. Besides, the speed adjust knob 10 is disposed outside the belt-disc sander to allow a user to set the rotating speed. The control circuit 25 can receive the speed adjust signal of the speed adjust knob 10 to adjust the rotating speed of the motor 12 to the set one. In the present invention, the speed adjust knob 10 is preferably a potentiometer.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

We claim:

1. A belt-disc sander having a speed adjuster for controlling the rotation speed of a motor of said belt-disc sander, said speed adjuster comprising:

a drive circuit for generating a sinusoidal pulse-width-modulation (SPWM) signal;

a converter coupled with said drive circuit for receiving said SPWM signal and generating a rotating speed control signal for driving said motor;

a current sensor coupled with said motor for feedback of the current of said motor;

a speed adjust knob for generating a speed adjust signal; and a control circuit coupled between said drive circuit and said speed adjust knob for controlling the rotating speed of said motor;

whereby said control circuit controls a frequency variation of said SPWM signal generated by said drive circuit in response to said speed adjust signal of said speed adjust knob, said rotating speed control signal output by said converter is adjusted according to the frequency variation of said SPWM signal for adjusting the rotating speed of said motor, and said control circuit determines whether the rotating speed of said motor conforms to that set by said speed adjust knob, thereby correcting the frequency variation of said SPWM signal generated by said drive circuit.

2. The belt-disc sander having a speed adjuster as claimed in claim 1, wherein said drive circuit is a sinusoidal pulse width modulation signal generator.

3. The belt-disc sander having a speed adjuster as claimed in claim 1, wherein said converter is a half-bridge inverter.

4. The belt-disc sander having a speed adjuster as claimed in claim 1, wherein said current sensor is a current transformer (CT).

5. The belt-disc sander having a speed adjuster as claimed in claim 1, wherein said speed adjust knob is a potentiometer.

6. The belt-disc sander having a speed adjuster as claimed in claim 1, wherein said control circuit is a micro-control unit.

7. The belt-disc sander having a speed adjuster as claimed in claim 1, wherein if said belt-disc sander operates at a fixed torque with low frequency variation, said control circuit increases the operating frequency of said motor to maintain the rotating speed constant and avoid saturation of said motor when the rotation speed of said motor is detected to be slowing down through said current sensor.

8. The belt-disc sander having a speed adjuster as claimed in claim 1, wherein said current sensor is coupled with said motor and said control circuit to form a closed loop.

9. The belt-disc sander having a speed adjuster as claimed in claim 1, wherein a protection time can be set by said control circuit, said control circuit monitors the operational status of said motor through said current sensor, and said control circuit issues a command to stop said motor if a jam time of said motor exceeds said protection time, or said control circuit activates said motor again if the jam time does not exceed said protection time.

10. The belt-disc sander having a speed adjuster as claimed in claim 1 further comprising a voltage doubling circuit coupled with said converter.

11. The belt-disc sander having a speed adjuster as claimed in claim 1 further comprising a full-wave rectifier coupled between said current sensor and said control circuit.

* * * * *